United States Patent [19]

Gisbourne

[11] 4,244,084

[45] Jan. 13, 1981

[54] JOINTING OF FABRIC ENDS

[75] Inventor: Bryan J. Gisbourne, Blackburn, England

[73] Assignee: Scapa-Porritt Limited, England

[21] Appl. No.: 927,412

[22] Filed: Jul. 24, 1978

[30] Foreign Application Priority Data

Aug. 31, 1977 [GB] United Kingdom ..... 36421/77

[51] Int. Cl.[3] ..... F16G 3/02; D21F 7/10

[52] U.S. Cl. ..... 24/33 C; 24/31 H; 28/141; 139/383 A; 162/DIG. 1; 245/10

[58] Field of Search ..... 24/33 C, 31 H, 38, 39, 24/207, 205.16; 139/383 A, 425 A; 28/141, 142; 162/DIG. 1; 245/10; 74/231 J

[56] References Cited

U.S. PATENT DOCUMENTS

| | | | |
|---|---|---|---|
| 3,653,097 | 4/1972 | Kerber | 24/33 C |
| 4,141,388 | 2/1979 | Romanski et al. | 139/383 A |

FOREIGN PATENT DOCUMENTS

| | | | |
|---|---|---|---|
| 288143 | 2/1971 | Austria | 139/383 A |
| 699989 | 12/1940 | Fed. Rep. of Germany | 245/10 |
| 2735750 | 2/1978 | Fed. Rep. of Germany | 139/383 A |
| 43-14167 | 6/1968 | Japan | 28/141 |
| 46-28681 | 8/1971 | Japan | 28/141 |
| 325773 | 7/1970 | Sweden | 139/383 A |
| 1040694 | 9/1966 | United Kingdom . | |
| 1114602 | 5/1968 | United Kingdom . | |
| 1348098 | 3/1974 | United Kingdom | 139/383 A |

*Primary Examiner*—James Kee Chi

*Attorney, Agent, or Firm*—Fleit & Jacobson

[57] ABSTRACT

A multi-layer papermarker's fabric is proposed wherein a helical coil is engaged individually with each of the plies of the fabric to define side-by-side loops protruding from the fabric end for interdigitation with corresponding loops at an opposed fabric end to receive a pintle wire, the arrangement being such that, in use, one ply of the fabric protects the helical coil and its connection with another ply of the fabric against wear and damage.

8 Claims, 6 Drawing Figures

JOINTING OF FABRIC ENDS

The invention concerns the joining of fabric ends, and has more particular reference to the joining of the ends of a flat-woven papermaker's felt or fabric to form an endless structure.

Various means have been proposed for joining together the ends of a flat-woven papermaker's felt or fabric, and such have met with varying degrees of success.

It is known, for example, to provide respective sets of wire loops secured to the ends to be joined, the loops extending in the longitudinal direction of the felt or fabric and being arranged in interdigitated disposition to receive a pintle wire into engagement therewith. The wire loops are generally of asymmetric U-shaped form, the limbs of such loops being of unequal length and each such limb having a respective inwardly directed barb or hook at its remote end for engagement with the felt or with a webbing to be applied to the felt. A typical seam of this type is disclosed in British Pat. Specification No. 1,040,694.

As a development of the "clipper seam" as aforesaid it has been proposed to utilize elongate wire loops such as will provide a passage of oval section in the interdigitated loops, and to locate two pintle wires in side-by-side disposition in such tunnel, the pintle wires, in use, being maintained in rolling contact by virtue of the tension in the felt on such flexing of the felt as occurs, for example, when passing over rollers. A clipper seam having two side-by-side wires is disclosed in prior British Pat. Specification No. 1,114,602.

In another class of seam, the loops at each fabric end are defined by the successive turns of a flattened helical coil provided at such end and held in position by the warp yarns of the fabric. Austrian Pat. Specification No. 288.143 disclosed an arrangement wherein the coil is partially engaged with an end region of the felt or fabric whereat the weft yarns have been removed, a pintle wire or the like being located axially of the coil at the reverse end of the fabric and the coil being drawn outwardly of the fabric to trap the pintle wire between the successive turns of the coil and the rear face of the fabric, the fabric end being folded about the pintle wire into a position of abutment with the said rear face and the overlying fabric plies being sewn together.

As an improvement in the arrangement disclosed in Austrian Pat. Specification No. 288.143, the helical coil is fully engaged with a weftless region of the fabric end and is secured in position relative thereto simply by pivoting the fabric end about the turns of the coil and sewing together the superimposed plies, a pintle wire being located axially of the coil prior to the engagement thereof with the fabric, if desired, to improve the performance of the connection. A typical arrangement as aforesaid is disclosed in British Pat. Specification No. 1,348,098.

One problem met with in connection with the coil-type seams as aforesaid is that any undue wear to the warp yarns in the region adjacent to the seam and/or damage to the stitching, whereby the fabric end is maintained in its folded condition, arising from wear adversely affects the security of the seam, and can lead, eventually, to seam failure, with obvious prejudicial consequences.

The object of the present invention is to provide a joining means of the 'coil type', of particular application in the context of multi-layer fabrics, which avoids the aforesaid problem.

According to the invention, there is proposed a papermaker's fabric or the like comprising a multi-layer fabric of which, in the end regions thereof, the individual plies are folded back towards the body of the fabric and are secured together in overlying disposition, and a helical coil secured to at least one of the plies at each respective end of the fabric by the warp yarns of such ply by the engagement of the successive turns of the coil in attaching relationship with a weft-free zone of the said ply, and about the axis of which weft-free zone the end region of the ply is folded.

The invention also includes the method of providing a multiplicity of side-by-side loops at a multi-layer fabric end for co-operation with corresponding loops at an opposed fabric end, and which are arranged in interdigitated relationship with the said side-by-side loops to receive a pintle wire into engagement therewith thus to form an endless fabric, such method comprising the steps of separating the plies in the end region of the fabric, removing the weft yarns from each ply at corresponding locations spaced from the extremity of the fabric, engaging a helical coil with the weft-free zone of the intended lower ply in attaching relationship therewith, and subsequently folding over the end of the intended upper ply about the axis of the weft-free zone therein and into engagement with the turns of the coil such that the said turns protrude outwardly therefrom.

According to a preferred feature, the end of the intended lower ply is folded inwardly of the fabric about the axis of the weft-free zone therein.

According to the further preferred feature, the helical coil is engaged with the weft-free zone of the intended lower ply in attaching relationship therewith in accordance with the method disclosed in our prior British Pat. Specification No. 1,348,098.

The invention will now be described further by way of example only, with reference to the accompanying diagrammatic wherein FIG. 1 illustrates a fabric end;

Figure 1:
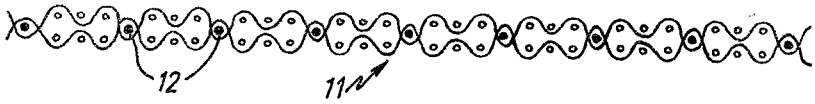
Figure 2:
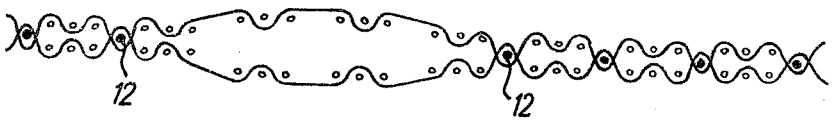
FIG. 2 illustrates the fabric end after the removal of three weft binder threads.
Figure 3:
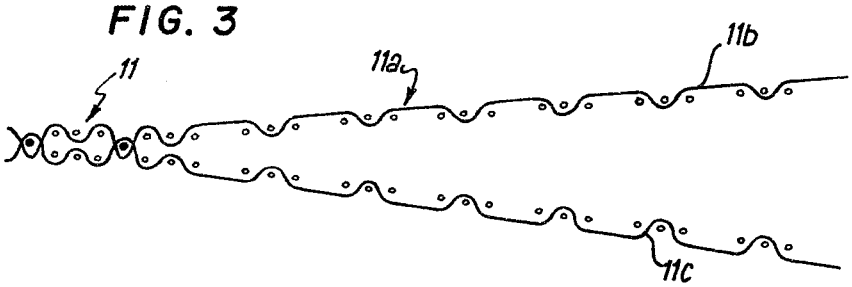
FIG. 3 illustrates the fabric end after the removal of additional weft binder threads.
Figure 4:
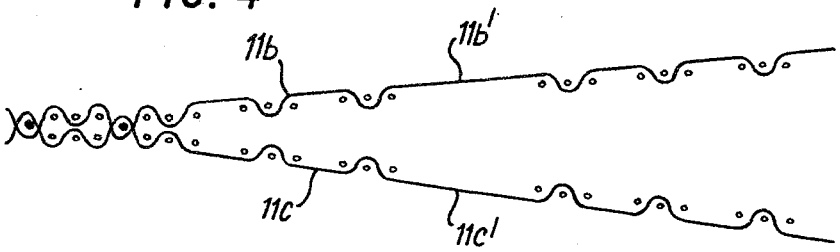
FIG. 4 illustrates the fabric end after the removal of select weft yarns.
Figure 5:
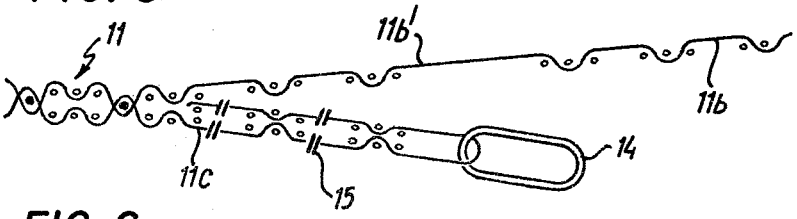
FIG. 5 illustrates the fabric end after preliminary steps of attaching a helical coil.
Figure 6:
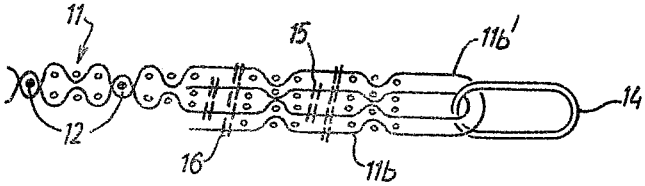
FIG. 6 illustrates the fabric end with the helical coil in place.

Thus, referring now to the drawings, the end region 11*a* of a double-layer fabric 11 is divided into two plies 11*b*, 11*c* by removal of the weft binder threads 12 therefrom, and weft yarns are removed from the individual plies at corresponding positions thereon to give respective weft-free zones 11*b*', 11*c*' spaced from the extremity of each of the separated plies 11*b*, 11*c*.

A helical coil 14 is engaged with the weft-free zone 11*c*' of the intended lower ply 11*c* in accordance with the method taught by British Pat. Specification No. 1,348,098, and is secured in position by sewing together the overlying elements of such lower ply, as by stitching 15. Thus, more particularly, successive turns of the coil are aligned with respective interstices in the fabric ply formed by the said removal of weft yarns at a position intermediate the plies, and such coil is engaged with the said interstices by pressing the coil into and partially through the ply until further passage is prevented by abutment of the turns against the warp yarns. The fabric end is then folded about the axis of the weft-free zone to hold the coil captive in such end, the end being secured in position relative to the body of the related ply by stitching 15. If desired, a reinforcing yarn or element may be located axially of the coil prior to its application to the intended lower ply, which reinforcing yarn or element, in the fully engaged position of the coil, lies between the turns thereof and the warp yarns.

The end region of the intended upper ply 11*b* is now folded about the axis of the weft-free zone 11*b*′ of such ply into engagement with the turns of the coil 14 extending outwardly from the folded end of the lower ply, the loops as formed by such successive turns protruding through the apertures formed in and by the weft-free zone 11*b*′ of the intended upper ply 11*b*, and the free end of the said upper ply being secured to the underside of the fabric, as by stitching 16.

As will readily be appreciated, the connection between the coil and the intended lower ply of the fabric is protected against mechanical damage and wear from external sources by the presence of the outer ply, such outer ply not only protecting the coil/warp yarn interface against the ingress of contaminants and abrasive materials, but also protecting the stitching of the lower ply against mechanical damage and wear.

The invention is not restricted to the exact features of the embodiment disclosed since alternatives will readily present themselves to one skilled in the art.

Thus, whilst we prefer to apply the coil to the lower ply in accordance with the teaching of British Pat. Specification No. 1,348,098, any other conventional method may be utilized.

What is claimed is:

1. A papermaker's fabric comprising a multi-layer fabric of which, in the end regions thereof, the individual ones of a plurality of plies are folded back towards the body of the fabric, and are secured together in overlying disposition, and a respective helical coil secured to at least one of the plies at each end of the fabric by the warp yarns of such ply by the engagement of the successive turns of the coil in attaching relationship with the warp yarns of a weft-free zone of the said ply and about the axis of which weft-free zone the end region of the ply is folded.

2. A papermaker's fabric as claimed in claim 1, wherein the said warp yarns extend about the turns of the coil and thereby hold the coil in position relative to the fabric.

3. A papermaker's fabric as claimed in claim 1, wherein the said ply comprises the intended lower ply, in use, of the multi-layer fabric.

4. The papermaker's fabric as claimed in claim 1, wherein such fabric or the like comprises two plies and wherein the helical coil at each respective end of the fabric is secured in position by the warp yarns of both plies, the intended upper ply, in use, thereby protecting the coil retaining warp yarns of the said lower ply.

5. A method of providing a multiplicity of side-by-side loops at a multi-layer fabric end for cooperation with corresponding loops at an opposed fabric end which are arranged in interdigitated relationship with the said side-by-side loops to receive a pintle wire into engagement therewith thus to form an endless fabric, such method comprising the steps of separating the plies in the end region of the fabric, removing weft yarns from each of the intended upper and lower plies at generally corresponding locations spaced from the extremity of the fabric, engaging a helical coil with the weft-free zone of the intended lower ply in attaching relationship therewith, and subsequently folding over the end of the intended upper ply about the axis of the weft-free zone therein and into engagement with the turns of the coil such that the said turns protrude outwardly therefrom.

6. The method as claimed in claim 5, wherein the end of the intended lower ply is folded inwardly of the fabric about the axis of the weft-free zone therein.

7. The method as claimed in claim 5, wherein the helical coil is engaged with the weft-free zone of the intended lower ply in attaching relationship therewith, by pressing such coil into full engagement with the interstices of the said weft-free zone and folding the end of the intended lower ply about the turns of the coil.

8. The method as claimed in claim 7, including the further step of introducing a reinforcing yarn into the coil prior to application thereof to the said weft-free zone.

* * * * *